US012589966B2

(12) United States Patent
Okada et al.

(10) Patent No.: US 12,589,966 B2
(45) Date of Patent: Mar. 31, 2026

(54) SHEET POSTPROCESSING DEVICE AND IMAGE FORMING SYSTEM INCLUDING THE SHEET POSTPROCESSING DEVICE

(71) Applicant: KYOCERA Document Solutions Inc., Osaka (JP)

(72) Inventors: Takehiko Okada, Osaka (JP); Yusuke Takano, Osaka (JP); Keisuke Egawa, Osaka (JP); Yasunori Ueno, Osaka (JP); Terumitsu Noso, Osaka (JP); Seiichi Shirasaki, Osaka (JP); Takuya Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 211 days.

(21) Appl. No.: 18/421,717

(22) Filed: Jan. 24, 2024

(65) Prior Publication Data

US 2024/0253931 A1 Aug. 1, 2024

(30) Foreign Application Priority Data

Jan. 31, 2023 (JP) ..... 2023-012736

(51) Int. Cl.
*B65H 29/24* (2006.01)
*B65H 31/38* (2006.01)
(Continued)

(52) U.S. Cl.
CPC ..... *B65H 29/247* (2013.01); *B65H 31/38* (2013.01); *B65H 39/10* (2013.01); *B65H 45/162* (2013.01);
(Continued)

(58) Field of Classification Search
CPC ..... B65H 37/04; B65H 37/06; B65H 31/38; B65H 45/16; B65H 2405/11152;
(Continued)

(56) References Cited

U.S. PATENT DOCUMENTS 8,936,240 B2 * 1/2015 Hoshino ..... B65H 31/10 271/211
10,781,066 B2 * 9/2020 Kishimoto ..... B65H 45/14
(Continued)

FOREIGN PATENT DOCUMENTS

JP 2019-206418 A 12/2019

*Primary Examiner* — Leslie A Nicholson, III
(74) *Attorney, Agent, or Firm* — Stein IP, LLC

(57) ABSTRACT

The sheet postprocessing device includes a sheet conveyance path, a sheet tray, a carry-in guide, a processing part, a discharge member, a blower device, and an intermediate conveyance part. The sheet tray includes an upstream-side stacking part. The intermediate conveyance part is provided at a position within a range from the upstream-side stacking part to the downstream-side stacking part in a conveyance direction, and allows a sheet to pass therethrough below the processing part. The intermediate conveyance part is made up by including an upstream part including a first clearance through which the sheet passes, and a downstream part placed on a downstream side of the upstream part and including a second clearance through which the sheet passes. A size of the second clearance in a planar direction perpendicular to a surface of the sheet is wider than a size of the first clearance in the planar direction.

10 Claims, 10 Drawing Sheets

(51) Int. Cl.
*B65H 39/10* (2006.01)
*B65H 45/16* (2006.01)

(52) U.S. Cl.
CPC ..... *B65H 2405/11152* (2013.01); *B65H 2801/27* (2013.01)

(58) Field of Classification Search
CPC .... B65H 2301/4505; B65H 2301/4461; B65H 29/24; B65H 29/245; B65H 29/246; B65H 29/247
USPC ..... 270/37
See application file for complete search history.

(56) References Cited

U.S. PATENT DOCUMENTS

| | | | | |
|---|---|---|---|---|
| 11,235,942 | B2 * | 2/2022 | Nakano | B65H 31/38 |
| 12,291,417 | B2 * | 5/2025 | Okada | B65H 45/18 |
| 12,319,528 | B2 * | 6/2025 | Egawa | B65H 29/14 |
| 2019/0367312 | A1 | 12/2019 | Kishimoto et al. | B65H 29/247 |

* cited by examiner

SHEET POSTPROCESSING DEVICE AND IMAGE FORMING SYSTEM INCLUDING THE SHEET POSTPROCESSING DEVICE

INCORPORATION BY REFERENCE

This application is based on and claims the benefit of priority from Japanese Patent Application No. 2023-012736 filed on Jan. 31, 2023, the contents of which are hereby incorporated by reference.

BACKGROUND

The present disclosure relates to a sheet postprocessing device, and an image forming system including the sheet postprocessing device.

Conventionally, there has been used a sheet postprocessing device in which sheets (print paper, envelopes, OHP films, etc.) with images formed thereon by an image forming apparatus (copiers, printers, etc.) are stacked in plurality and formed into a bundle state, the bundle being subjected to specified postprocessing. The specified postprocessing refers to a stapling process (process of stapling a sheet bundle with a stapler), a folding process (process of two-folding or three-folding sheets), or the like.

Among such sheet postprocessing devices described above are those which execute a specified folding process. Such a sheet postprocessing device includes a sheet tray, a sheet conveyance path, a processing part, and a blower device. A sheet, passing through the sheet conveyance path, is stacked on the sheet tray. A carry-in guide guides the sheet, which is passing on the sheet conveyance path, to the sheet tray. The processing part performs specified postprocessing (folding process, stapling process, etc.) on sheets stacked on the sheet tray.

The blower device is enabled to blow air to between an upper surface of the uppermost sheet out of sheets stacked on the sheet tray and a lower surface of a sheet fed out from the carry-in guide toward the sheet tray to form an air layer. Once an air layer is formed, the sheet fed out from the carry-in guide toward the sheet tray becomes less likely to come into close contact with sheets already stacked on the sheet tray.

SUMMARY

A sheet postprocessing device according to one aspect of the present disclosure includes a sheet conveyance path, a sheet tray, a carry-in guide, a processing part, a discharge member, a blower device, and an intermediate conveyance part. On the sheet conveyance path, a sheet is conveyed in a specified conveyance direction. The sheet tray includes an upstream-side stacking part placed on an upstream side and a downstream-side stacking part placed on a downstream side, each in the conveyance direction, and a specified number of sheets that have passed through the sheet conveyance path are stacked on the sheet tray. The carry-in guide is placed on an upstream side of the sheet tray and at a downstream end of the sheet conveyance path in the conveyance direction, and allows the sheet to be carried onto the sheet tray through the sheet conveyance path. The processing part is placed within a range from the upstream-side stacking part to the downstream-side stacking part in the conveyance direction, and performs specified postprocessing on the sheets stacked on the sheet tray. The discharge member is placed on a downstream side of the processing part in the conveyance direction, and discharges the sheets, which have been subjected to the postprocessing, to the downstream side of the conveyance direction. The blower device blows off air from upstream side to downstream side of the conveyance direction and toward between an upper surface of an uppermost sheet out of the sheets stacked on the sheet tray and a lower surface of the sheet carried from the carry-in guide onto the sheet tray. The intermediate conveyance part is provided at a position within a range from the upstream-side stacking part to the downstream-side stacking part in the conveyance direction, and allows the sheet to pass therethrough below the processing part. The intermediate conveyance part includes an upstream part including a first clearance through which the sheet passes, and a downstream part placed on a downstream side of the upstream part and including a second clearance through which the sheet passes, and a size of the second clearance in a planar direction perpendicular to a surface of the sheet is wider than a size of the first clearance in the planar direction.

DETAILED DESCRIPTION

Hereinafter, an embodiment of the present disclosure will be described with reference to the accompanying drawings.

Figure 1:
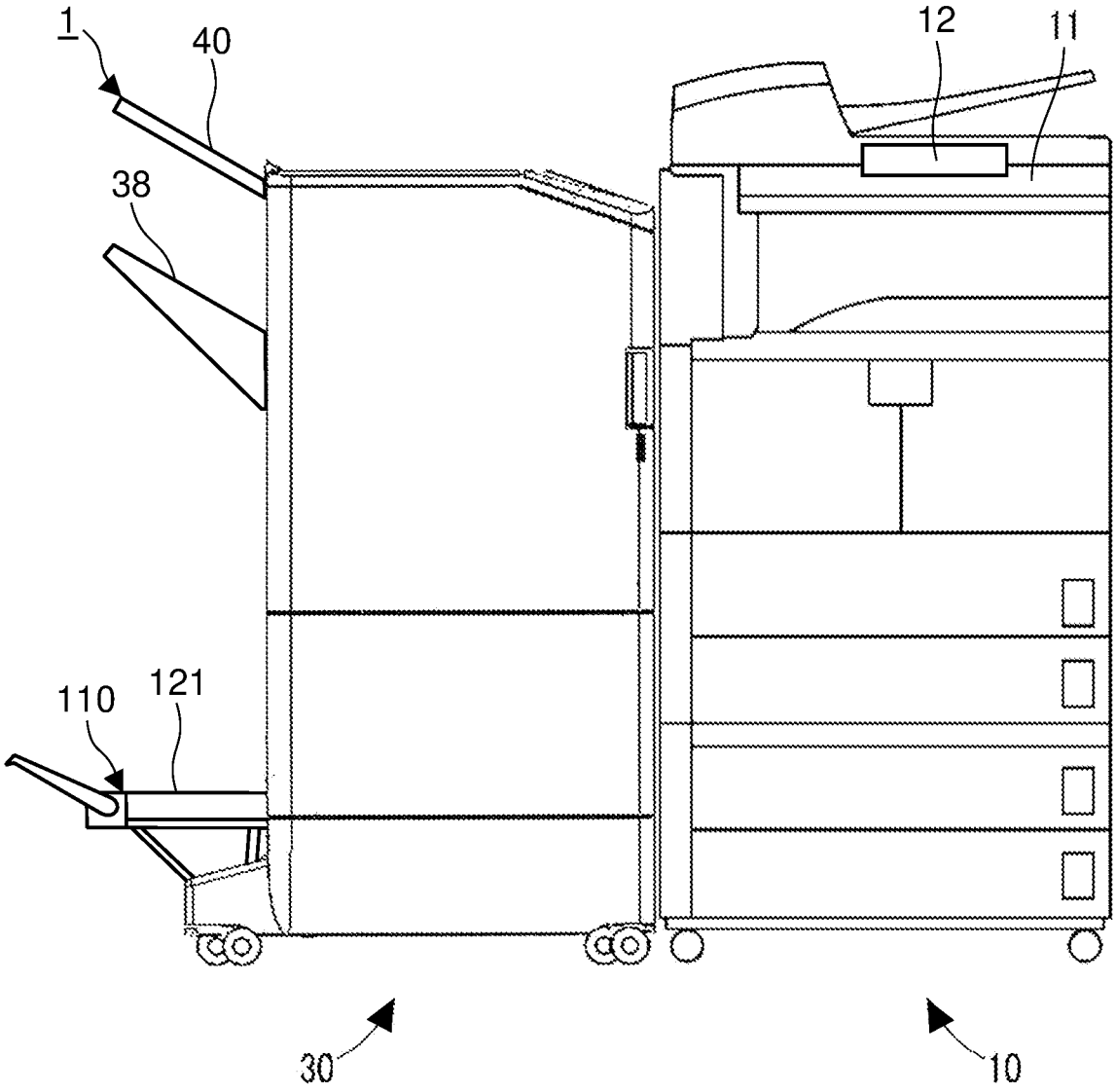
FIG. 1 is a schematic view showing an image forming apparatus and a sheet postprocessing device from which an image forming system is formed.

FIG. 1 is a schematic view showing an image forming apparatus 10 and a sheet postprocessing device 30 from which an image forming system 1 is formed. As shown in FIG. 1, the image forming system 1 includes the image forming apparatus 10 and the sheet postprocessing device 30. First, a description will be given below about the image forming apparatus 10.

The image forming apparatus 10 is put into use as it is coupled to the sheet postprocessing device 30. Based on image data entered from external via an unshown network communication part, or on image data read by an image reading part 11 placed on top of the image forming apparatus 10, the image forming apparatus 10 prints out images on sheets S (print paper, envelopes, OHP films, etc.).

Hereinafter, a conveyance direction of a sheet S will be referred to as 'sheet conveyance direction', similarly a widthwise direction (direction perpendicular to the sheet conveyance direction) of a sheet S as 'sheet widthwise direction', and a direction perpendicular to a plane of a sheet S (direction perpendicular to the sheet conveyance direction and to the sheet widthwise direction) as 'sheet planar direction'.

Figure 2:
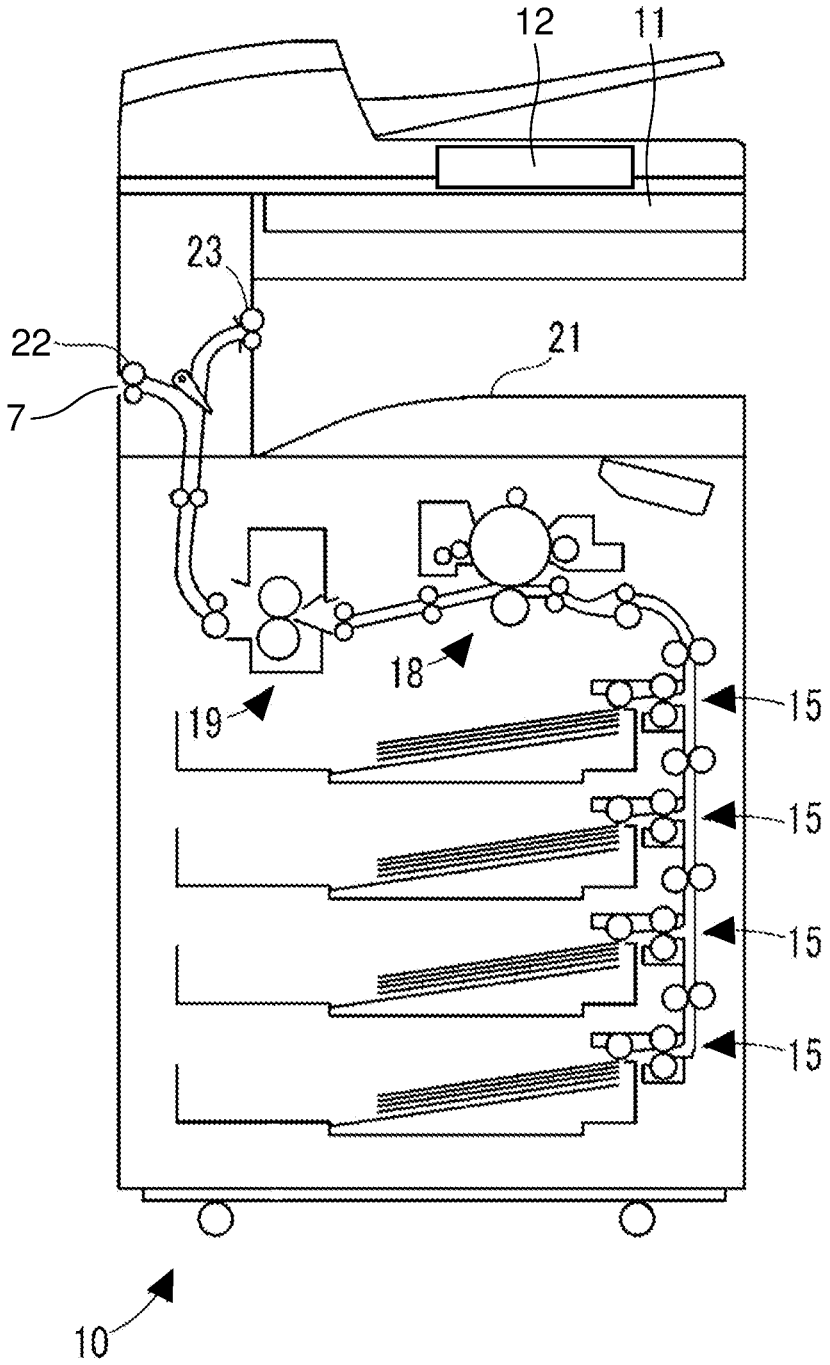
FIG. 2 is a schematic view showing an internal configuration of the image forming apparatus.

FIG. 2 is a schematic view showing an internal configuration of the image forming apparatus 10. As shown in FIG. 2, the image forming apparatus 10 includes sheet feed parts 15, an image forming part 18, a fixing part 19, an in-trunk sheet discharge part 21, and discharge roller pairs 22, 23.

Each sheet feed part 15 feeds a sheet S to the image forming part 18. The image forming part 18 forms a toner image on the sheet S. The fixing part 19 fixes the toner image on the sheet S. The in-trunk sheet discharge part 21 is a part provided in a trunk of a main body of the image forming apparatus 10 and serving as a sheet discharge destination for the sheet S. The discharge roller pair 23 discharges the after-fixation sheet S to the in-trunk sheet discharge part 21. The discharge roller pair 22 discharges the after-fixation sheet S to the sheet postprocessing device 30.

Next, a description of the sheet postprocessing device 30 is given below. For the sheet S conveyed up from the image forming apparatus 10, the sheet postprocessing device 30 performs specified postprocessing such as a punch-hole forming process, a stapling process, and a folding process. First, out of configurations of the sheet postprocessing device 30, a configuration as to the punch-hole forming process and a first stapling process (=stapling process performed by a later-described first stapling device 35) is described below.

Figure 3:
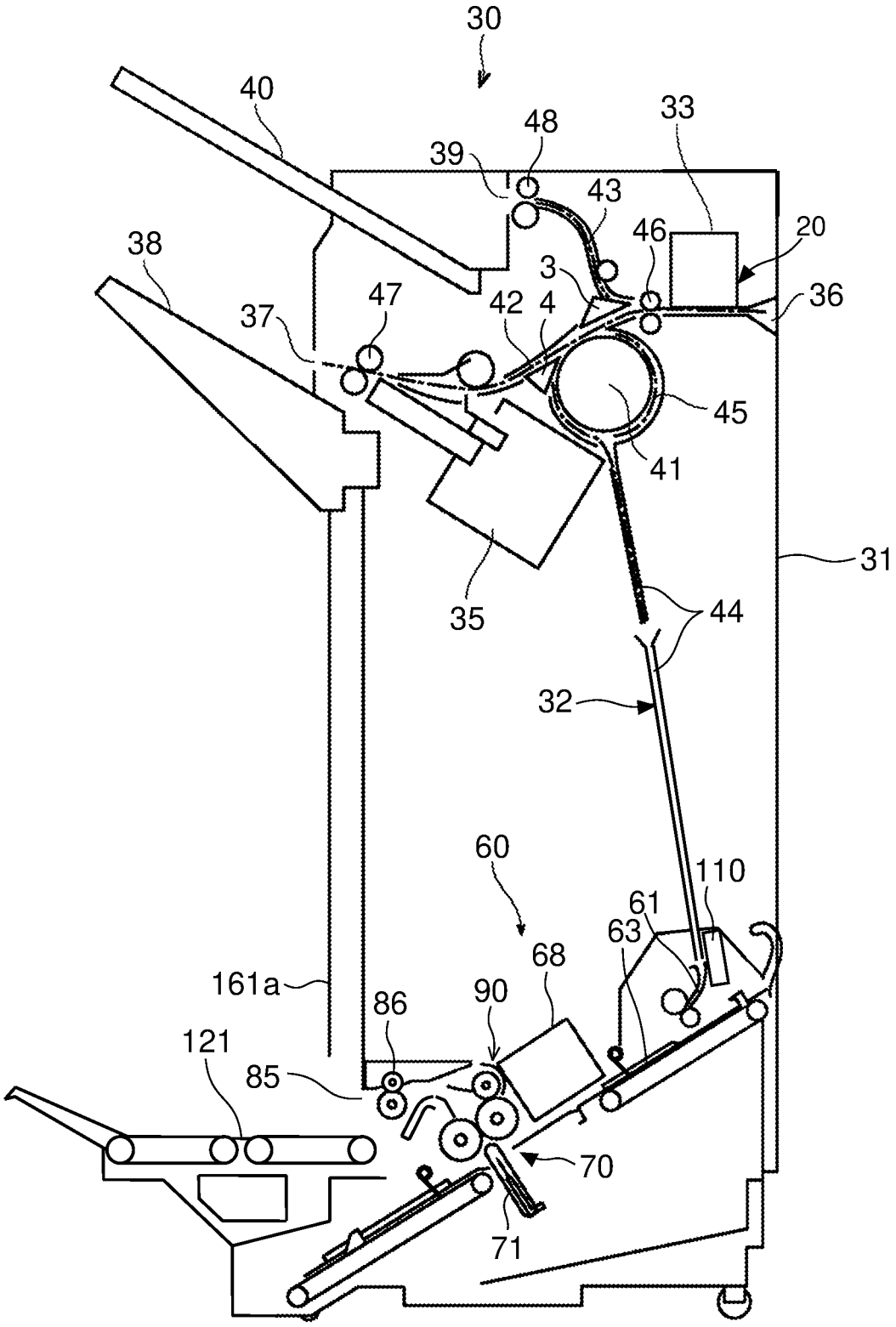
FIG. 3 is a schematic view showing an internal configuration of the sheet postprocessing device.

FIG. 3 is a schematic view showing an internal configuration of the sheet postprocessing device 30. As shown in FIG. 3, the sheet postprocessing device 30 includes a sheet inlet 36, a main discharge part 38, a sub discharge part 40, a lower discharge part 121, a sheet conveyance path 32, a retractive drum 41, a registration roller pair 46, a punch-hole forming device 33 (processing part), and a first stapling device 35 (processing part).

The sheet inlet 36 accepts a sheet S discharged from a discharge part 7 (see FIG. 2) of the image forming apparatus 10. The main discharge part 38, the sub discharge part 40, and the lower discharge part 121 are plate-shaped members capable of stacking sheets S on their top surfaces, and each of those members serves as a final discharge destination for sheets S carried through the sheet inlet 36 into the sheet postprocessing device 30.

The main discharge part 38 is up/down movably supported on a side face 161*a* (side face on an opposite side to the image forming apparatus 10) of a main body of the sheet postprocessing device 30. The main discharge part 38 is moved up and down in response to a stacking quantity of stacked sheets S. A main discharge port 37 is formed in the side face 161*a*. The main discharge port 37 is positioned further upward of the main discharge part 38 that is positioned uppermost.

The sub discharge part 40 is fixed at an upper portion of the sheet postprocessing device 30 and upward of the main discharge part 38. A sub discharge port 39 is formed at a position which is in an upper portion of the main body of the sheet postprocessing device 30 and which is upward of an upstream-side end portion of the sub discharge part 40 in the sheet conveyance direction.

The lower discharge part 121 is held at a lower portion of the sheet postprocessing device 30 downward of the main discharge part 38. A lower discharge port 85 is formed in the side face 161*a* upward of the lower discharge part 121.

The sheet conveyance path 32 is a path formed inside the sheet postprocessing device 30 to convey sheets. A sheet S carried in through the sheet inlet 36 inward of the sheet postprocessing device 30, passing along the sheet conveyance path 32, is conveyed to a specified site in the sheet postprocessing device 30. The sheet conveyance path 32 is made up of a first conveyance path 42, a second conveyance path 43, a third conveyance path 44, and a fourth conveyance path 45.

The first conveyance path 42 extends over a range from the sheet inlet 36 to the main discharge port 37. A main discharge roller pair 47 is provided at a downstream-side end portion of the first conveyance path 42 in the sheet conveyance direction. The main discharge roller pair 47 is a pair of roller members which are forward-and-reverse rotatable so as to be brought into pressure contact with each other or separated apart from each other. The main discharge roller pair 47 is enabled to convey a sheet S along the sheet conveyance direction to the main discharge part 38, or convey a sheet S in a direction opposite to the sheet conveyance direction toward the later-described first stapling device 35.

For conveyance of a sheet S to the main discharge part 38, the main discharge roller pair 47 is set into mutual pressure contact and rotated forward so as to feed out the sheet S, which has entered between the rollers, via the main discharge port 37 to the main discharge part 38. Conversely, for carry-in of the sheet S into the first stapling device 35, the main discharge roller pair 47 is set into mutually separate state, letting the sheet S to enter between the rollers. Subsequently, the main discharge roller pair 47 is set into mutual pressure contact and rotated reverse so as to feed out the sheet S toward the first stapling device 35.

The second conveyance path 43 branches upward from the first conveyance path 42, extending toward the sub discharge port 39. An upstream-side end portion of the second conveyance path 43 is connected to a midway position of the first conveyance path 42, while a downstream-side end portion of the second conveyance path 43 is connected to the sub discharge port 39. A first branch member 3 is provided at a connecting portion between the first conveyance path 42 and the second conveyance path 43. The first branch member 3 distributes a sheet S, which has been carried in through the sheet inlet 36, to a downstream side of the first conveyance path 42 or to the second conveyance path 43.

A sub discharge roller pair 48 is provided at the downstream-side end portion of the second conveyance path 43. The sub discharge roller pair 48 feeds out the sheet S, which has been conveyed to the second conveyance path 43, through the sub discharge port 39 to the sub discharge part 40.

The third conveyance path 44 branches and extends downward from the first conveyance path 42. An upstream-side end portion of the third conveyance path 44 is connected via a later-described fourth conveyance path 45 to a position downstream of a branch portion of the first conveyance path 42 from the second conveyance path 43. The third conveyance path 44 extends downward such that its downstream-side end portion is connected to a later-described sheet folding device 60.

The fourth conveyance path 45 is an annular-shaped conveyance path which branches from the first conveyance path 42 and merges again with the first conveyance path 42. More specifically, the fourth conveyance path 45 branches from the first conveyance path 42 at a position downstream of a branch portion between the first conveyance path 42 and the second conveyance path 43 and, at a further downstream-side position, merges again with the first conveyance path 42. The upstream-side end portion of the third conveyance path 44 is connected to a midway position of the fourth conveyance path 45.

A second branch member 4 is placed at a connecting portion between the first conveyance path 42 and the fourth conveyance path 45. The second branch member 4 distributes the sheet S, which has been distributed to the downstream side of the first conveyance path 42 by the first branch member 3, to a further downstream side of the first conveyance path 42 or via the fourth conveyance path 45 to the third conveyance path 44.

The retractive drum 41 is a roller member rotatably provided inside the annular-shaped fourth conveyance path 45. An outer circumferential surface of the retractive drum 41 is opposed to an inner circumferential surface of the fourth conveyance path 45 to define the fourth conveyance path 45.

The retractive drum 41 is rotated while keeping its outer circumferential surface in contact with the sheet S, which has been distributed toward the third conveyance path 44 by the second branch member 4, so that the sheet S is once retracted to the fourth conveyance path 45. Subsequently, the retractive drum 41 feeds the sheet S once again to the first conveyance path 42. For example, in a case where a plurality of sheet bundles are continuously subjected to a stapling process, during execution of the stapling process with a preceding sheet bundle, the retractive drum 41 makes a first-order sheet S of the next sheet bundle retracted to the fourth conveyance path 45. Then, the first-order sheet S is conveyed from the fourth conveyance path 45 again to the first conveyance path 42 so as to be conveyed to the first stapling device 35 with a second-order sheet S superposed thereon.

The registration roller pair 46 is placed at a position of the first conveyance path 42 upstream of the first branch member 3. The registration roller pair 46 feeds out, toward a downstream side, a sheet S carried in through the sheet inlet 36.

The punch-hole forming device 33 is placed between the sheet inlet 36 and the registration roller pair 46 in the sheet conveyance direction. The punch-hole forming device 33 is vertically opposed to a sheet S conveyed on the first conveyance path 42. The punch-hole forming device 33 performs a punching process at a specified timing on the sheet S conveyed through the first conveyance path 42.

The first stapling device 35 is placed, downward of the first conveyance path 42, at a position upstream of the main discharge roller pair 47 and downstream of a connecting portion between the first conveyance path 42 and the third conveyance path 44. The first stapling device 35 performs a stacking process and a stapling process on a plurality of sheets S carried in by above-described operation of the main discharge roller pair 47. The terms 'stacking process' refers to a process of stacking a plurality of sheets S to form a sheet bundle. The terms 'stapling process' refers to a process of stapling the stacked sheet bundle with a stapler.

Next, a configuration of the sheet postprocessing device 30 associated with a folding process and a second stapling process (=stapling process performed by a later-described second stapling device 68).

Figure 4:
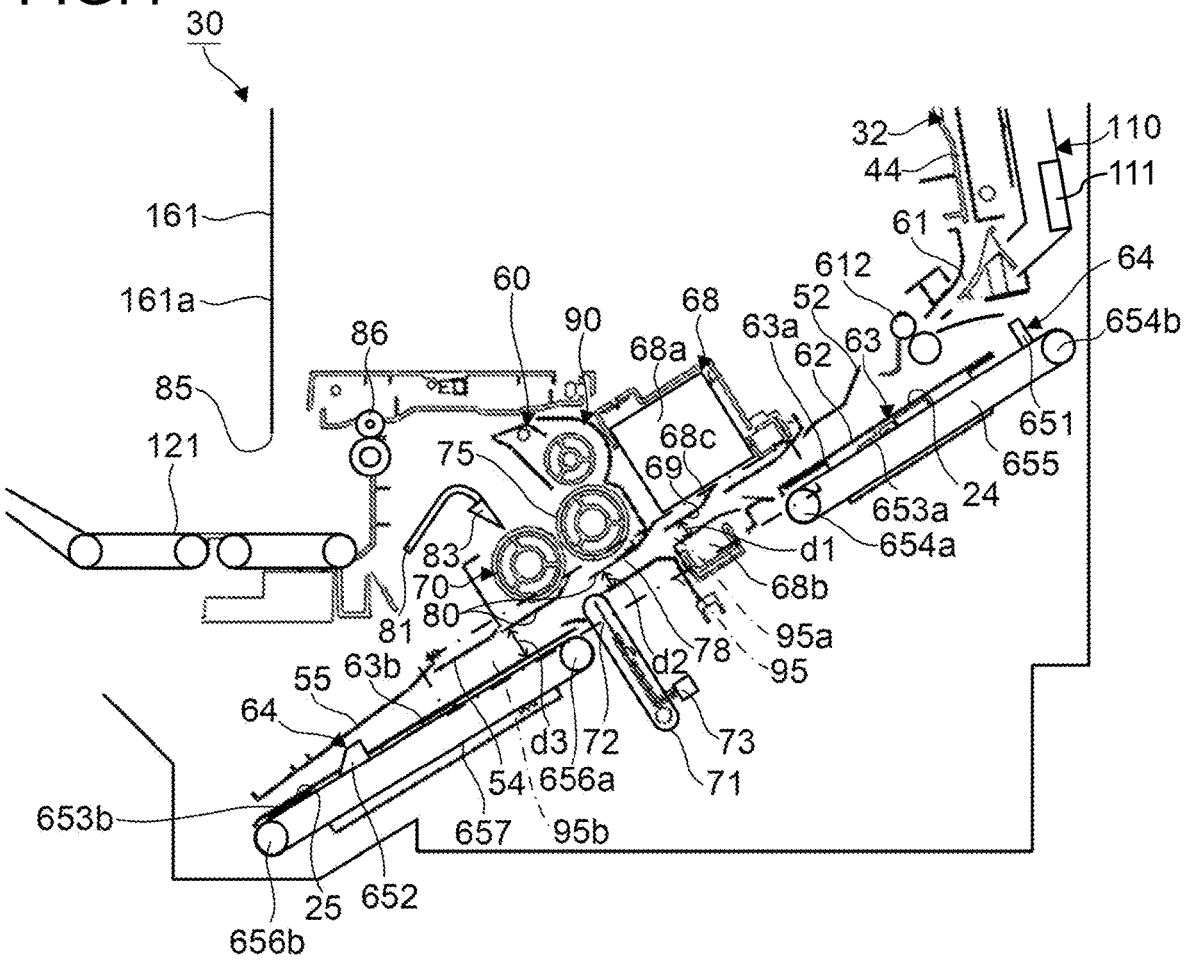
FIG. 4 is a sectional view showing an internal configuration of around a sheet folding device in the sheet postprocessing device.

FIG. 4 is a sectional view showing an internal configuration of around a sheet folding device 60 in the sheet postprocessing device 30. As shown in FIG. 4, in addition to the above-described configuration, the sheet postprocessing device 30 further includes a sheet carry-in path 61 (carry-in guide), a sheet tray 63, an intermediate conveyance part 95, a sheet folding device 60 (processing part), an alignment member 65, a sheet shifting part 64, a second stapling device 68 (processing part), and a discharge roller pair 86 (discharge member).

The sheet carry-in path 61 is placed upstream of the sheet tray 63 and downstream of the sheet conveyance path 32 in the sheet conveyance direction. The sheet carry-in path 61 is a carry-in path for conveying a sheet S, which has been conveyed up along the third conveyance path 44, toward the sheet tray 63. A detailed configuration of around the sheet carry-in path 61 will be described later.

The sheet tray 63 is placed downstream of the sheet conveyance path 32 in the sheet conveyance direction. A sheet S, which has passed through the sheet carry-in path 61, is stacked on the sheet tray 63. The sheet tray 63 is made up by including an upstream-side stacking part 63*a* and a downstream-side stacking part 63*b*.

The upstream-side stacking part 63*a* and the downstream-side stacking part 63*b* are plate-shaped members. The downstream-side stacking part 63*b* is placed downstream of the upstream-side stacking part 63*a* in the sheet conveyance direction. The upstream-side stacking part 63*a* and the downstream-side stacking part 63*b* are arrayed in line with an interval therebetween.

An upstream-side stacking surface 24 (see FIG. 8) is formed on an upper surface of the upstream-side stacking part 63*a*. A downstream-side stacking surface 25 (see FIG. 9) is formed on an upper surface of the downstream-side stacking part 63*b*. The upstream-side stacking surface 24 and the downstream-side stacking surface 25, which are placed flush with each other along the sheet conveyance direction, forms a sheet stacking surface 62. The sheet stacking surface 62 is inclined downward from upstream side toward downstream side in the sheet conveyance direction.

The intermediate conveyance part 95 is a space formed downward of the second stapling device 68 and the sheet folding device 60. In more detail, the intermediate conveyance part 95 is formed at a position ranging from the upstream-side stacking part 63*a* to the downstream-side stacking part 63*b* in the sheet conveyance direction. Sheets S fed onto the sheet tray 63 are conveyed downstream through the intermediate conveyance part 95.

The intermediate conveyance part 95 is made up by including an upstream part 95*a* and a downstream part 95*b*. The upstream part 95*a* is a part of the intermediate conveyance part 95 overlapping with the second stapling device 68 in the sheet conveyance direction. The downstream part 95*b* is a part of the intermediate conveyance part 95 positioned downstream of the upstream part 95*a* in the sheet conveyance direction. The downstream part 95*b* is so positioned as to overlap with the sheet folding device 60 in the sheet conveyance direction.

A first clearance is formed in the upstream part 95*a*. A second clearance is formed in the downstream part 95*b*. Sheets S conveyed to the sheet tray 63 are conveyed downstream through the first clearance and the second clearance.

The upstream part 95*a* is made up by including an upstream-side opposing surface 69. The first clearance is a clearance formed between the upstream-side opposing surface 69 and the sheet tray 63 (more specifically, upstream-side stacking part 63*a*). The downstream part 95*b* is made up by including a downstream-side opposing surface 80. The second clearance is a clearance formed between the downstream-side opposing surface 80 and the sheet tray 63 (more specifically, downstream-side stacking part 63*b*). Details of the upstream-side opposing surface 69, the downstream-side opposing surface 80, the first clearance, and the second clearance will be described later.

As shown in FIG. 4, the sheet folding device 60 is provided at a lower portion of the sheet postprocessing device 30 and downstream of the third conveyance path 44 (more specifically, downstream of the sheet carry-in path 61). The sheet folding device 60 performs, for example, a folding process, i.e. a two-folding process or a three-folding process, on sheets S when a folding process is selected by a user.

The sheet folding device 60 includes a first folding device 70, a standby path 81, a second folding device 90, and a conveyance-destination changeover member 83.

The first folding device 70 performs a first folding process that makes a sheet S folded in two. The first folding device 70 includes an extrusion mechanism 71, a first folding roller pair 75, and a folding guide 78. The extrusion mechanism 71 extrudes sheets S. The first folding roller pair 75 performs a folding process on the sheets S extruded by the extrusion mechanism 71.

The extrusion mechanism 71 includes a folding blade 72 and an extrusion driving part 73. The folding blade 72 is a metallic plate-shaped member. The folding blade 72 is placed between the upstream-side stacking part 63*a* (detailed later) and the downstream-side stacking part 63*b* (detailed later) in the sheet conveyance direction. The folding blade 72 is held reciprocatively movable in a sheet stacking direction.

The extrusion driving part 73, which is made up by including a motor capable of outputting driving force and a plurality of gears (not shown), is connected to the folding blade 72. The extrusion driving part 73 outputs rotation driving force to the folding blade 72 to make the folding blade 72 reciprocatively moved.

Figure 5:
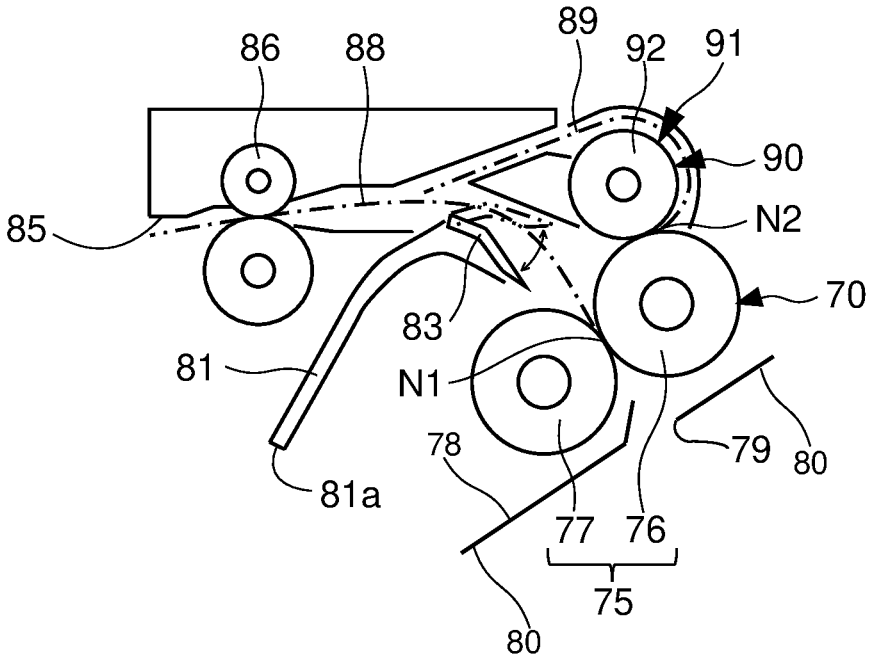
FIG. 5 is a sectional view showing, under enlargement, a vicinity of a first folding device.

FIG. 5 is a sectional view showing, under enlargement, a vicinity of the first folding device 70. As shown in FIGS. 4 and 5, the first folding roller pair 75 is composed of a first roller 76 and a second roller 77.

The first roller 76 and the second roller 77, which are in pressure contact with each other, form a first nip portion N1 therebetween. The first roller 76 and the second roller 77 are driven into rotation by a driving part via a power transmission mechanism (neither shown). On a downstream side of the first nip portion N1, provided is a first discharge conveyance path 88 leading to the lower discharge port 85.

As shown in FIGS. 4 and 5, the folding guide 78 is provided between the first folding roller pair 75 and the sheet tray 63 in the sheet planar direction. In more detail, the folding guide 78 is a portion of the sheet folding device 60 opposed to the sheet tray 63.

The folding guide 78 has an introductory opening 79 formed at such a position as to overlap with the folding blade 72 in the sheet conveyance direction. The introductory opening 79 extends through the folding guide 78 in the sheet planar direction. The above-mentioned downstream-side opposing surface 80 is formed on one side of the folding guide 78 closer to the sheet tray 63. The downstream-side opposing surface 80 is a plane parallel to the sheet tray 63. The downstream-side opposing surface 80 is brought into contact with sheets S extruded by the folding blade 72, causing the sheets S to be flexed, and guides the sheets S as such to the introductory opening 79.

The downstream-side opposing surface 80 is made up by including a first guide surface 80*a* and a second guide surface 80*b*. The first guide surface 80*a* and the second guide surface 80*b* are arrayed with the introductory opening 79 interposed therebetween in the sheet conveyance direction. The first guide surface 80*a* is positioned upstream of the second guide surface 80*b* in the sheet conveyance direction.

Figure 6:
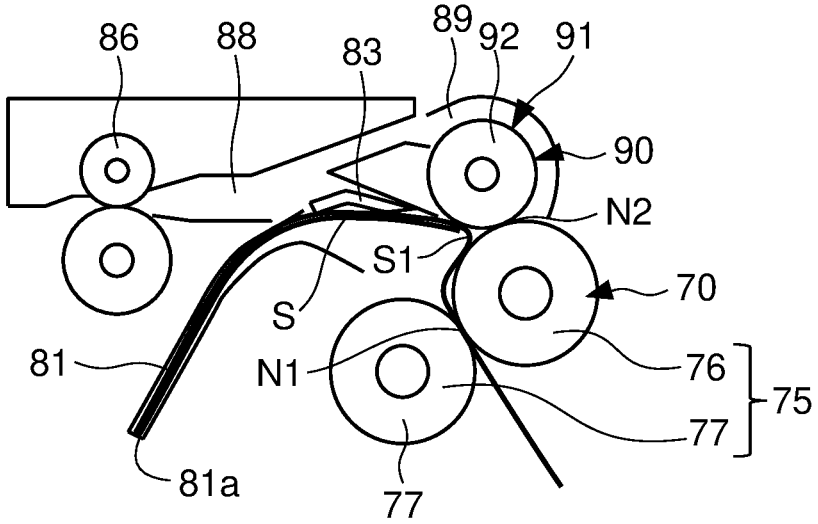
FIG. 6 is a sectional view showing, under enlargement, the first folding device in which a sheet has been carried.

FIG. 6 is a sectional view showing, under enlargement, the first folding device 70 in which sheets S have been carried. The standby path 81 branches from the first discharge conveyance path 88. As shown in FIG. 6, the standby path 81 allows the sheets S, which have been subjected to the first folding process by the first folding device 70, to enter therein while making the sheets S flexed and stood by. The standby path 81 is formed so as to be compatible with a thickness of a maximum count of sheets S for which the folding process by the sheet folding device 60 is executable. For example, in a case where the folding process is executable with one to five counts of sheets S, the standby path 81 has such a clearance that sheets S having a thickness resulting from folding (executing the first folding process) of five sheets S (a thickness corresponding to ten sheets S) are enterable therein.

A stopper 81*a* is provided at a downstream end of the standby path 81. A first fold of sheets S entering (standing by on) the standby path 81 butts against the stopper 81*a*.

The second folding device 90 performs a second folding process on sheets S that have butted against the stopper 81*a*. The second folding device 90 includes a second folding roller pair 91. The second folding roller pair 91 is composed of the above-mentioned first roller 76, and a third roller 92.

The first roller 76 and the third roller 92, which are in pressure contact with each other, forms a second nip portion N2 therebetween. The third roller 92 is rotated in subordination to the first roller 76.

The conveyance-destination changeover member 83 is provided at a branch portion between the standby path 81 and the first discharge conveyance path 88. The conveyance-destination changeover member 83 guides the sheets S, which have been subjected to the first folding process, with a changeover to the first discharge conveyance path 88 or the standby path 81. In a case where the sheets S that have been subjected to the first folding process are to be conveyed to the lower discharge port 85 without being subjected to the second folding process, the conveyance-destination changeover member 83 guides the sheets S from the first nip portion N1 directly to the first discharge conveyance path 88 (see FIG. 7).

Reverting to FIG. 5, a second discharge conveyance path 89 which merges with the first discharge conveyance path 88 is provided downstream of the second nip portion N2. The second discharge conveyance path 89 is a conveyance path for conveying sheets S, which have been subjected to the second folding process, via the first discharge conveyance path 88 to the lower discharge port 85.

The discharge roller pair 86 is placed downstream of the sheet folding device 60. More specifically, the discharge roller pair 86 is provided at a downstream end of the first discharge conveyance path 88. The discharge roller pair 86 discharges sheets S, which have been subjected to specified postprocessing (more specifically, at least one of the above-mentioned folding process by the sheet folding device 60 or a stapling process by the second stapling device 68) to a downstream side (more specifically, to the lower discharge part 121).

Referring to FIGS. 4 to 7, the folding process (operation) of sheets S by the sheet folding device 60 is described below. First, a two-folding process is described. The two-folding process is executed when a two-folding mode is selected by the user with an operation panel 12 (see FIG. 2) of the image forming apparatus 10. The conveyance-destination changeover member 83 is pivoted to a position indicated by solid line in FIG. 5, in which position the conveyance destination of the sheets S subjected to the first folding process by the first folding device 70 is set to the first discharge conveyance path 88.

The sheets S carried in through the sheet carry-in path 61 are laid on the upstream-side stacking part 63*a* and the downstream-side stacking part 63*b*. Then, the alignment member 65 (detailed later) aligns the sheets S for their edge portions in the sheet widthwise direction. Subsequently, the sheet shifting part 64 (detailed later) performs a positioning (shifting) of the sheets S in such a way that a folding position (central portion in the sheet conveyance direction) of the sheets S and a fore end of the folding blade 72 overlap with each other in the sheet conveyance direction.

Next, the folding blade 72 is projected in a direction opposite to the sheet stacking direction. As a result of this, the fore end of the folding blade 72 is brought into contact with a back surface of the sheets S, so that the sheets S are extruded upward (in a direction perpendicular to the sheets S) by the projection of the folding blade 72.

The sheets S extruded by the folding blade 72 are brought into contact with the folding guide 78. In this state, the sheets S are guided to the introductory opening 79 by the downstream-side opposing surface 80. Then, the sheets S enter the first nip portion N1 through the introductory opening 79. Subsequently, the sheets S are pinched by the first roller 76 and the second roller 77 at the first nip portion N1, passing through the first nip portion N1, with a result that a first fold is formed in the sheet S.

Figure 7:
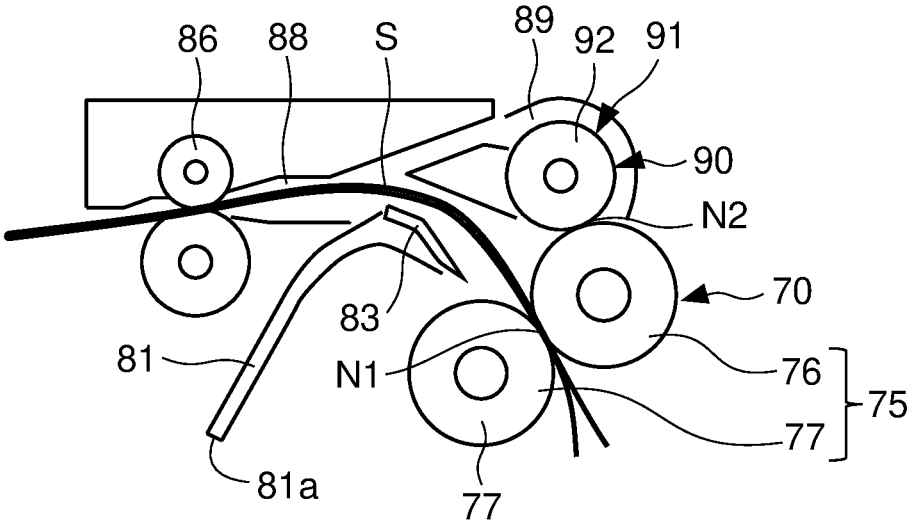
FIG. 7 is a sectional view showing, under enlargement, the first folding device in which a sheet has been carried.

As shown in FIG. 7, the sheets S in which the first fold has been formed are discharged from the lower discharge port 85 through the first discharge conveyance path 88 to the lower discharge part 121. In addition, the extrusion mechanism 71 returns the folding blade 72 to its original standby position. After this on, similarly in continuation, the folding process is executed.

Next, the three-folding process is described. The three-folding process is executed when a three-folding mode is selected by the user with the operation panel 12 (see FIG. 2) of the image forming apparatus 10. Since process lasting until the sheets S are subjected to the first folding process by the first folding device 70 is the same as that of the foregoing two-fold folding process, except that the folding position of the sheets S is set to an about ⅓ position of a sheet length measuring from the fore end of the sheets S; therefore, its description is omitted.

Reverting to FIG. 5, in the three-folding mode, the conveyance-destination changeover member 83 is pivoted to a position indicated by two-dot chain line of FIG. 5, so that the conveyance destination of the sheets S subjected to the first folding process by the first folding device 70 is set to the standby path 81. Therefore, the sheets S subjected to the first folding process are conveyed toward the standby path 81. When the sheets S have entered the standby path 81, the first fold (fore end) of the sheets S butts against the stopper 81*a*.

Even after the first fold of the sheets S has butted against the stopper 81*a*, the first folding roller pair 75 continues rotational drive. Therefore, as shown in FIG. 6, the sheets S, while keeping in contact with an inner surface of the curved standby path 81 or the conveyance-destination changeover member 83 or the like, are flexed more and more so as to be convex toward the second nip portion N2 of the second folding roller pair 91. Thus, a flexed portion S1 is generated in the sheets S.

Then, the flexed portion S1 (about ⅓ position of the sheet length from a rear end of the sheets S) generated in the sheets S enters the second nip portion N2. By the flexed portion S1 being pinched between the first roller 76 and the third roller 92 at the second nip portion N2 and having passed therethrough, a second fold is formed in the sheets S.

The sheets S in which the second fold has been formed are conveyed on the second discharge conveyance path 89 while winding on a circumferential surface of the third roller 92. Thus, the sheets S are discharged through the lower discharge port 85 to the lower discharge part 121 by the discharge roller pair 86.

Next, a configuration of the alignment member 65 and the sheet shifting part 64 is described in detail. The alignment member 65 aligns sheet-widthwise end edges of sheets S laid on the sheet tray 63. The alignment of the sheets S by the alignment member 65 is executed each time one sheet S is stacked on the sheet tray 63.

Reverting to FIG. 4, the alignment member 65 includes an upstream-side width alignment member 653*a* and a downstream-side width alignment member 653*b*. The upstream-side width alignment member 653*a* and the downstream-side width alignment member 653*b* are movable in the sheet widthwise direction so as to conform to a size (sheet-widthwise length) of a sheet S. By the upstream-side width alignment member 653*a* and the downstream-side width alignment member 653*b* being brought into contact with both end edges of the sheet S in the sheet widthwise direction, width alignment and skew correction of the sheet S are executed.

Figure 8:
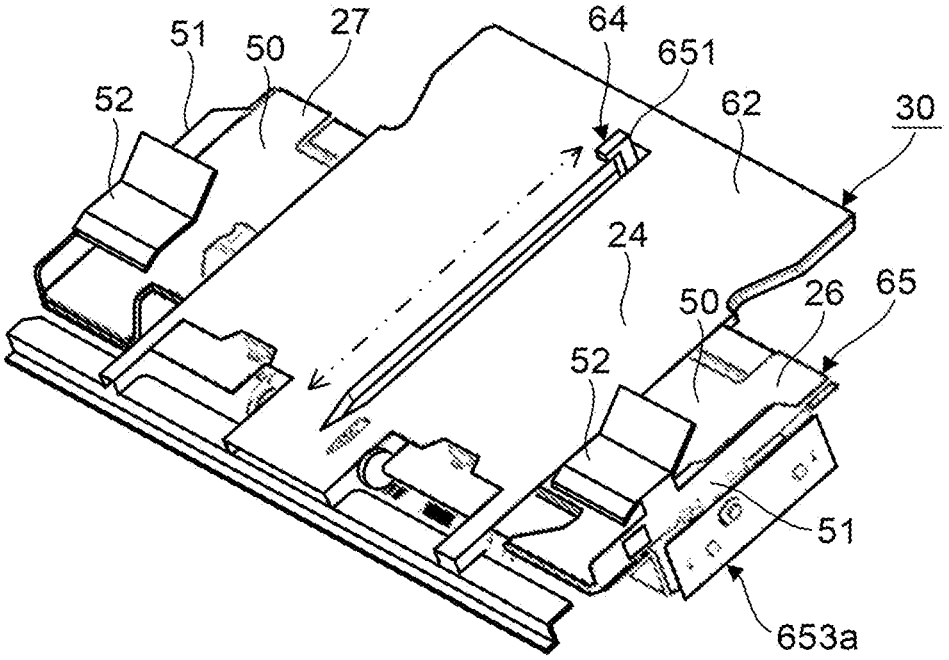
FIG. 8 is a perspective view showing an upstream-side stacking part.

FIG. 8 is a perspective view showing the upstream-side stacking part 63*a*. As shown in FIG. 8, the upstream-side width alignment member 653*a* is composed of a pair of first restricting members 26, 27. The first restricting members 26, 27 are arrayed in the sheet widthwise direction. The first restricting members 26, 27 are so positioned as to overlap with the upstream-side stacking part 63*a* in the sheet conveyance direction. The first restricting members 26, 27 are supported on the upstream-side stacking part 63*a* by a rack-and-pinion mechanism (not shown) so as to be reciprocatively movable in the sheet widthwise direction.

The first restricting members 26, 27 are symmetrical in the sheet widthwise direction and basically identical in configuration to each other. Therefore, hereinafter, description will be given about the first restricting member 26 only, and description of the first restricting member 27 will be omitted, with like reference signs assigned to like members.

The first restricting member 26 includes an upstream-side bottom face 50, an upstream-side side wall portion 51, and an upstream-side flat portion 52. The upstream-side bottom face 50 is a plane parallel to the upstream-side stacking surface 24. The upstream-side bottom face 50 is positioned downward of the upstream-side stacking surface 24. That is, the upstream-side bottom face 50 is positioned farther from sheets S than the upstream-side stacking surface 24 under a condition that the sheets S are stacked on the sheet stacking surface 62.

The upstream-side side wall portion 51 is a portion shaped into a plate perpendicular to the upstream-side bottom face 50. The upstream-side side wall portion 51 adjoins an outer (sheet-widthwise outer-side) end edge of the upstream-side bottom face 50 in the sheet widthwise direction.

The upstream-side flat portion 52 is a plate-shaped portion parallel to the upstream-side bottom face 50. The upstream-side flat portion 52 extends from an end edge of the upstream-side side wall portion 51 in a direction opposite to the sheet stacking direction, toward a sheet-widthwise inner side (toward a center of the upstream-side stacking surface 24 in the sheet widthwise direction). The upstream-side flat portion 52 is opposed to the upstream-side bottom face 50 in the sheet stacking direction.

Figure 9:
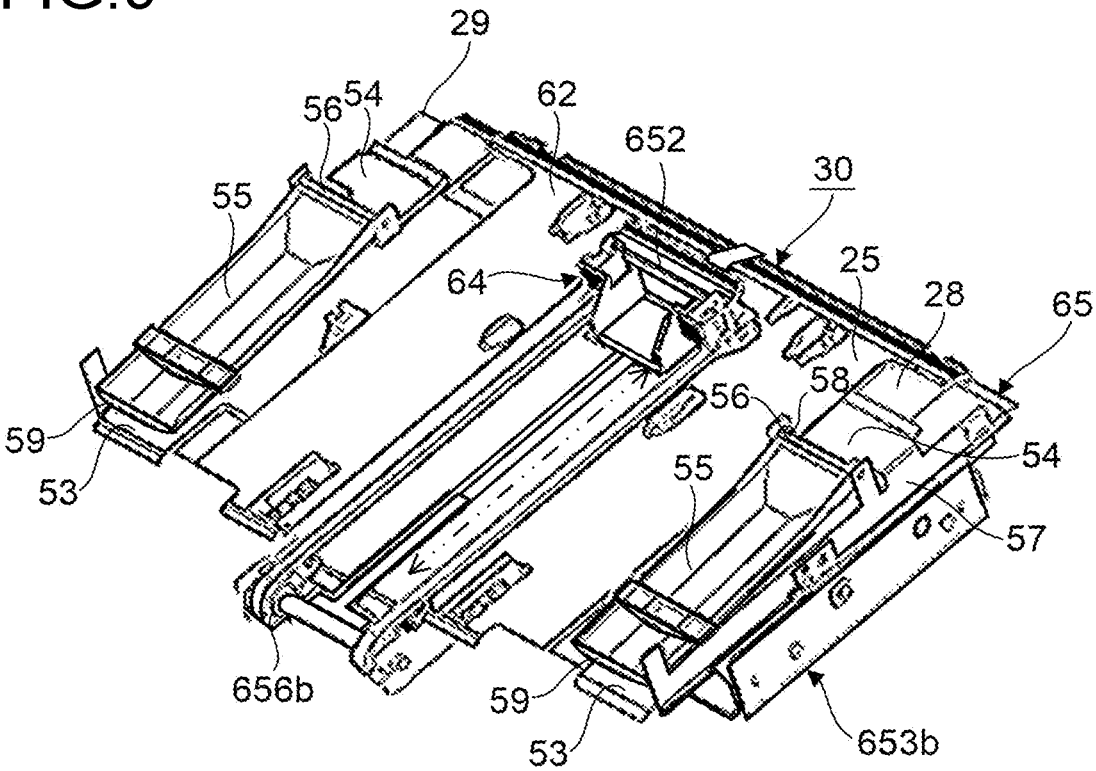
FIG. 9 is a perspective view showing a downstream-side stacking part.
Figure 10:
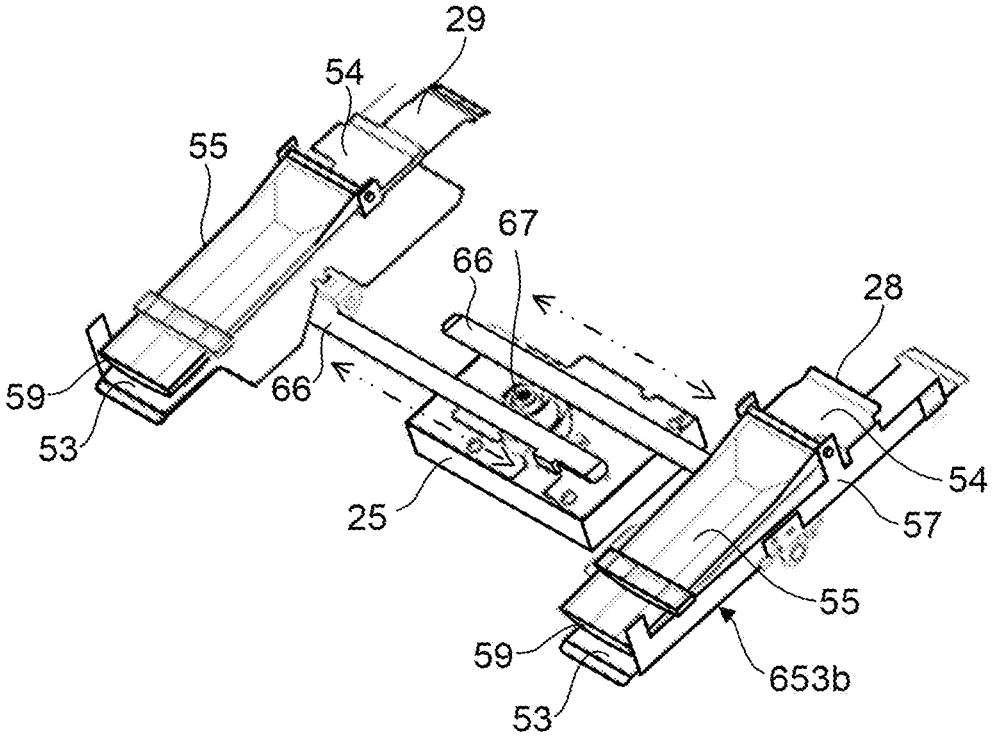
FIG. 10 is a perspective view showing a downstream-side width alignment member.

FIG. 9 is a perspective view showing the downstream-side stacking part 63*b*. FIG. 10 is a perspective view showing the downstream-side width alignment member 653*b*. As shown in FIGS. 9 and 10, the downstream-side width alignment member 653*b* is composed of second restricting members 28, 29. The second restricting members 28, 29 adjoin each other in the sheet widthwise direction. The second restricting members 28, 29 are so positioned as to overlap with the downstream-side stacking part 63*b* in the sheet conveyance direction.

Since the second restricting members 28, 29 are symmetrical in the sheet widthwise direction and basically identical in configuration to each other, description will be given below about the second restricting member 28 only and description of the second restricting member 29 will be omitted with like reference signs assigned to like members.

As shown in FIGS. 9 and 10, the second restricting member 28 includes a downstream-side bottom face 53, a rack gear 66, a downstream-side side wall portion 57, a downstream-side flat portion 54 (downstream-side guide plate), and a swinging guide 55. The downstream-side bottom face 53 is a plane parallel to the downstream-side stacking surface 25. The downstream-side bottom face 53 is positioned downward of the downstream-side stacking surface 25. That is, the downstream-side bottom face 53 is positioned farther from sheets S than the downstream-side stacking surface 25 under a condition that the sheets S are stacked on the sheet stacking surface 62.

The rack gear 66 extends from the downstream-side bottom face 53 along the sheet widthwise direction beyond a center of the downstream-side stacking part 63*b*. The rack gear 66 of the second restricting member 28 and the rack gear 66 of the second restricting member 29 are opposed to each other in the sheet conveyance direction. A pinion gear 67 is placed between the rack gear 66 of the second restricting member 28 and the rack gear 66 of the second restricting member 29. The pinion gear 67 is rotatably supported by the downstream-side stacking part 63*b*.

The rack gears 66 of the second restricting members 28, 29 and the pinion gear 67 are engaged with each other, respectively, to form a rack-and-pinion mechanism. The pinion gear 67, which is connected to a driving part such as a motor (not shown), is rotated by rotation driving force outputted by the driving part. By the pinion gear 67 being rotated and via the rack gears 66, the second restricting members 28, 29 are reciprocatively moved so as to become closer to each other or farther from each other along the sheet widthwise direction.

The downstream-side side wall portion 57 is a plate-shaped portion perpendicular to the downstream-side bottom face 53. The downstream-side side wall portion 57 adjoins an outer (one side of the downstream-side stacking surface 25 opposite to its center in the sheet widthwise direction) end edge of the downstream-side bottom face 53 in the sheet widthwise direction.

When the second restricting members 28, 29 are moved to become closer to each other in the sheet widthwise direction so that the downstream-side side wall portions 57 of the second restricting members 28, 29 are brought into contact with sheet-widthwise both end edges of the sheets S stacked on the downstream-side stacking surface 25, the second restricting members 28, 29 make both end edges of the sheets S adjusted (aligned) at a specified position in the sheet widthwise direction.

The downstream-side flat portion 54 is a plate-shaped portion parallel to the downstream-side bottom face 53. The downstream-side flat portion 54 extends from an end edge of the downstream-side side wall portion 57 in a direction opposite to the sheet stacking direction toward a sheet-widthwise inner side (toward a center of the downstream-side stacking surface 25 in the sheet widthwise direction). The downstream-side flat portion 54 is opposed to the downstream-side bottom face 53 in the sheet stacking direction.

The sheet shifting part 64 shifts the sheets S laid on the sheet tray 63 to a specified position in the sheet conveyance direction. A shift of the sheets S by the sheet shifting part 64 is executed after alignment of the sheets S by the alignment member 65. As shown in FIGS. 8 and 9, the sheet shifting part 64 includes an upper shifting member 651 and a lower shifting member 652.

As shown in FIGS. 4 and 8, the upper shifting member 651 is supported by the upstream-side stacking part 63*a* so as to be reciprocatively movable in the sheet conveyance direction. Downward of the upstream-side stacking part 63*a*, provided are an upstream-side driving pulley 654*a* and an upstream-side driven pulley 654*b* (see FIG. 4). On and between the upstream-side driving pulley 654*a* and the upstream-side driven pulley 654*b*, an upstream-side belt 655 is stretched (see FIG. 4). The upstream-side driving pulley 654*a*, which is connected to a driving part such as a motor (not shown), is rotated by rotation driving force of this driving part. By the upstream-side driving pulley 654*a* being rotated, the upstream-side belt 655 is subordinately rotated, causing the upper shifting member 651 to be reciprocatively moved.

As shown in FIGS. 4 and 9, the lower shifting member 652 is supported by the downstream-side stacking part 63*b* so as to be reciprocatively movable in the sheet conveyance direction. Downward of the downstream-side stacking part 63*b*, provided are a downstream-side driving pulley 656*a* and a downstream-side driven pulley 656*b* (see FIG. 4). On and between the downstream-side driving pulley 656*a* and the downstream-side driven pulley 656*b*, a downstream-side belt 657 is stretched (see FIG. 4).

The lower shifting member 652 is attached to the downstream-side belt 657. The downstream-side driving pulley 656*a*, which is connected to a driving part such as a motor (not shown), is rotated by rotation driving force of this driving part. By the downstream-side driving pulley 656*a* being rotated, the downstream-side belt 657 is subordinately rotated, causing the lower shifting member 652 to be reciprocatively moved.

The lower shifting member 652 is put into contact with a fore end (downstream-side end portion in the sheet conveyance direction) of sheets S stacked on the sheet stacking surface 62, receiving the fore end of the sheets S. The upper shifting member 651 is put into contact with a rear end (upstream-side end portion in the sheet conveyance direction) of the sheets S received by the lower shifting member 652. Like this, the upper shifting member 651 and the lower shifting member 652 are put into contact with both end edges, in the sheet conveyance direction, of the sheets S stacked on the sheet tray 63 to fulfill alignment of the sheets S with their fore end and rear end adjusted at specified positions.

As shown in FIGS. 9 and 10, the swinging guide 55 is a plate-shaped member formed slender along the sheet conveyance direction. The swinging guide 55 is supported by the downstream-side side wall portion 57 so as to be swingable along a circumferential direction of a swinging shaft 56 by the swinging shaft 56 extending parallel to the sheet widthwise direction. The swinging guide 55 is positioned downstream of the downstream-side flat portion 54 in the sheet conveyance direction. The swinging guide 55 is so positioned as to overlap with the downstream-side flat portion 54 in the sheet widthwise direction.

Figure 11:
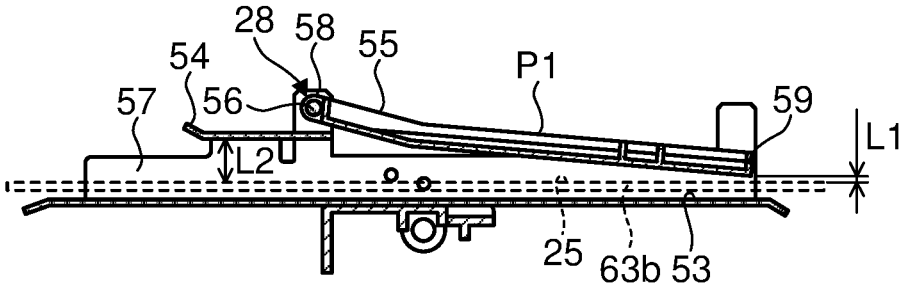
FIG. 11 is a sectional view showing a cross section of a second restricting member perpendicular to a sheet widthwise direction in a state in which a swinging guide is in a standby position.
Figure 12:
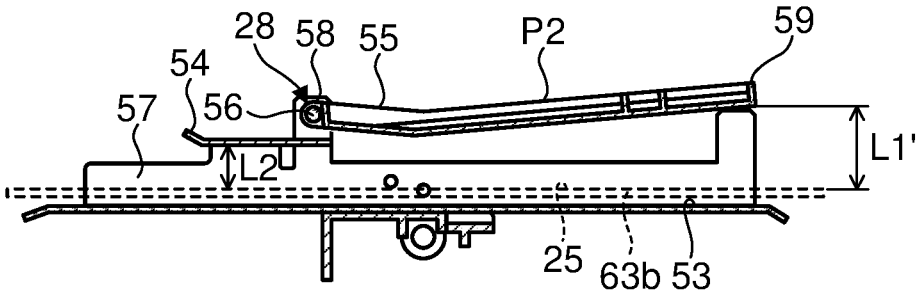
FIG. 12 is a sectional view showing a cross section of the second restricting member perpendicular to the sheet widthwise direction in a state in which the swinging guide is in a retractive position.
Figure 13:
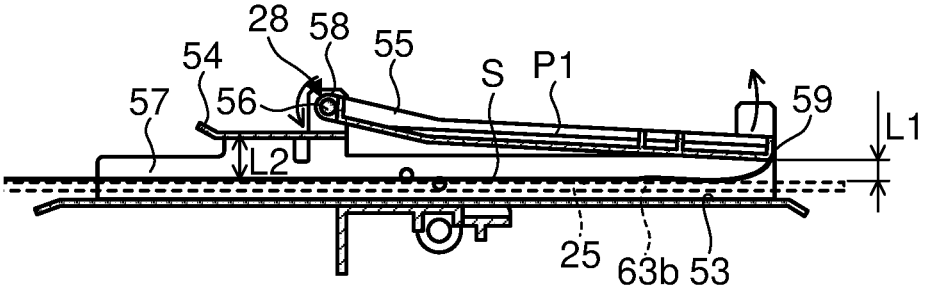
FIG. 13 is a sectional view showing a cross section of the second restricting member perpendicular to the sheet widthwise direction in a state in which a sheet stacked on a downstream-side stacking surface is in contact with an up/down portion.

FIG. 11 is a sectional view showing a cross section of the second restricting member 28 perpendicular to the sheet widthwise direction in a state with the swinging guide 55 in a standby position P1. FIG. 12 is a sectional view showing a cross section of the second restricting member 28 perpendicular to the sheet widthwise direction in a state with the swinging guide 55 in a retractive position P2. FIG. 13 is a sectional view showing a cross section of the second restricting member 28 perpendicular to the sheet widthwise direction in a state in which the sheets S stacked on the downstream-side stacking surface 25 are in contact with an up/down portion 59.

As shown in FIGS. 11 to 13, the swinging guide 55 includes a support portion 58 and an up/down portion 59. The support portion 58 is formed at a portion of the swinging guide 55 which is positioned upstream of its center portion in the sheet conveyance direction. More specifically, the support portion 58 is an upstream end portion of the swinging guide 55 in the sheet conveyance direction. The support portion 58 is opposed to the downstream-side side wall portion 57 in the sheet widthwise direction. The up/down portion 59 is a downstream end portion of the swinging guide 55 in the sheet conveyance direction.

The swinging shaft 56, which extends through the downstream-side side wall portion 57 and the support portion 58 along the sheet widthwise direction, is fixed to the downstream-side side wall portion 57. The swinging shaft 56 extends with a slight clearance formed against the support portion 58. The swinging guide 55 is swingable in the circumferential direction of the swinging shaft 56. When the swinging guide 55 swings along the circumferential direction of the swinging shaft 56, the up/down portion 59 goes closer to (goes down) or farther (goes up) from the downstream-side stacking surface 25 and the downstream-side bottom face 53.

A third clearance is formed between the swinging guide 55 and the sheet tray 63 (more specifically, downstream-side stacking part 63*b*).

The swinging guide 55 swings between the standby position P1 and the retractive position P2. The standby position P1 refers to a position (position shown in FIG. 11) in which the up/down portion 59 is closer to the downstream-side stacking surface 25 than the downstream-side flat portion 54 in the sheet stacking direction. In this state, a length L1 between the up/down portion 59 and the downstream-side stacking surface 25 is smaller than a length L2 between the downstream-side flat portion 54 and the downstream-side stacking surface 25. The swinging guide 55 is placed in the standby position P1 by its self weight in no contact with sheets S. The swinging guide 55, while positioned in the standby position P1, restricts movement of the sheets S on the sheet tray 63 in the sheet planar direction.

The retractive position P2 refers to a position (position shown in FIG. 12) in which the up/down portion 59 is farther from the downstream-side stacking surface 25 than the downstream-side flat portion 54 in the sheet stacking direction. In this state, a length L1' between the up/down portion 59 and the downstream-side stacking surface 25 is larger than the length L2 between the downstream-side flat portion 54 and the downstream-side stacking surface 25. When a fore end (downstream-side end portion in the sheet conveyance direction) of the sheets S stacked on the downstream-side stacking surface 25 has come into contact with a proximity to the up/down portion 59 of the swinging guide 55, the swinging guide 55 is biased against the retractive position P2.

As shown in FIG. 13, sheets S for conveyance to the downstream-side stacking part 63*b* are conveyed to between the downstream-side flat portion 54 as well as the swinging guide 55 and the sheet stacking surface 62 in the sheet stacking direction. In a case where the fore end (downstream-side end portion in the sheet conveyance direction) of a sheet S is curling, the up/down portion 59 is brought into contact with the sheet S. In this case, a curling portion of the sheet S presses the up/down portion 59 upward. Conversely, the swinging guide 55 presses the curling portion, by its self weight, against pressing force of the sheet S. Thus, the curl of the sheet S is corrected. In this case, the swinging guide 55 is biased from the standby position P1 toward the retractive position P2 by restoring force generated at the curling portion of the sheet S.

Reverting to FIG. 4, the second stapling device 68 is enabled to perform the stapling process for sheets S stacked on the sheet stacking surface 62. The second stapling device 68 is made up by including an upper stapling part 68*a*, a lower stapling part 68*b*, and a stapling guide 68*c* (upstream-side guide plate).

As shown in FIG. 4, the upper stapling part 68*a*, the lower stapling part 68*b*, and the stapling guide 68*c* are so positioned as to overlap with one another in the sheet conveyance direction. The upper stapling part 68*a* is opposed to the sheet tray 63 in the sheet planar direction. Also, the lower stapling part 68*b* is opposed to the upper stapling part 68*a* in the sheet planar direction.

The stapling guide 68*c* is opposed to the sheet tray 63 at a position in which the stapling guide 68*c* is closer to the sheet tray 63 than the upper stapling part 68*a* in the sheet planar direction. In other words, the stapling guide 68*c* is positioned between the upper stapling part 68*a* and the lower stapling part 68*b*. The stapling guide 68*c* is positioned upstream of the folding guide 78 in the sheet conveyance direction. The above-mentioned upstream-side opposing surface 69 is formed on one surface of the stapling guide 68*c* facing the sheet tray 63 in the sheet planar direction.

The second stapling device 68, while pinching sheets S between the upper stapling part 68*a* and the lower stapling part 68*b*, performs the stapling process on the sheets S. For this process, the stapling guide 68*c* guides the sheets S to a position for execution of the stapling process, and makes a positioning. More specifically, by contact with the upstream-side opposing surface 69, the sheets S are positioned at a specified stapling position.

Figure 14:
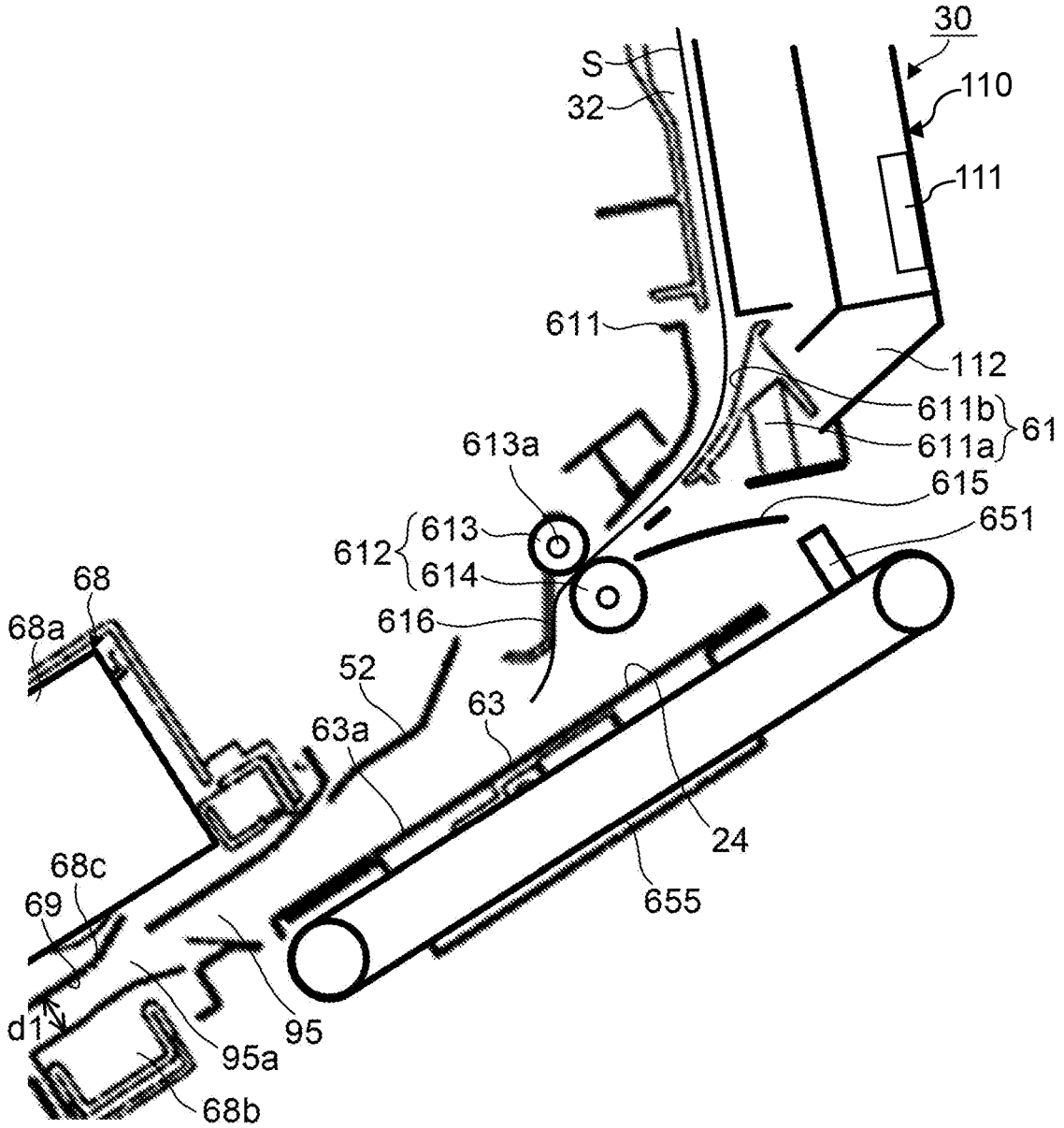
FIG. 14 is an enlarged view showing details of around a sheet carry-in path.

Next, a detailed structure of around the sheet carry-in path 61 is described below. FIG. 14 is an enlarged view showing details of around the sheet carry-in path 61. As shown in FIGS. 4 and 14, in addition to the above-described configuration, the sheet postprocessing device 30 further includes a carry-in roller pair 612 (carry-in member), a guide member 615, a presser member 616, and a blower device 110.

The carry-in roller pair 612 is provided at a downstream end of the sheet carry-in path 61. The carry-in roller pair 612 feeds out a sheet S, which is passing through the sheet carry-in path 61, toward the sheet tray 63.

Figure 15:
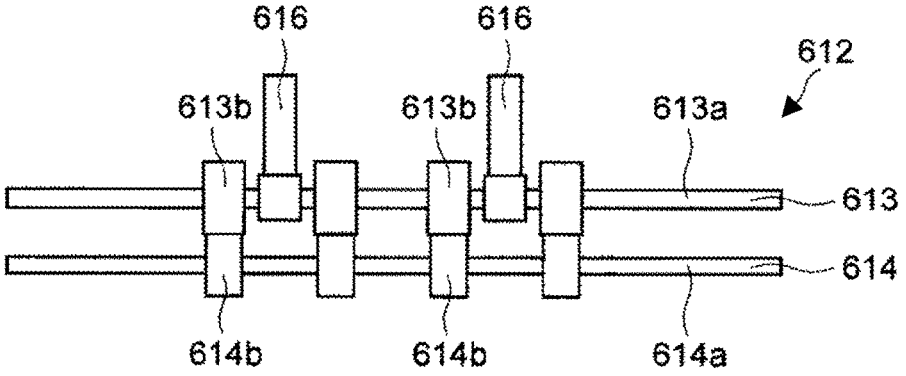
FIG. 15 is a plan view showing a structure of a carry-in roller pair.

FIG. 15 is a plan view showing a structure of the carry-in roller pair 612. As shown in FIGS. 14 and 15, the carry-in roller pair 612 is made up by including a driving roller 613 and a driven roller 614. As shown in FIG. 15, the driving roller 613 includes a rotating shaft 613*a*, and a plurality of roller elements 613*b*. Each roller element 613*b* is fixed to the rotating shaft 613*a*. The roller elements 613*b* are arrayed in an axial direction of the rotating shaft 613*a* with a specified interval.

The driven roller 614 is put into pressure contact with the driving roller 613. The driven roller 614 includes a rotating shaft 614*a* and a plurality of roller elements 614*b*. The plurality of roller elements 614*b* are placed with a specified interval in an axial direction, and fixed to the rotating shaft 614*a*. Each roller element 614*b* is put into pressure contact with the driving roller 613.

The guide member 615 is provided downward of the sheet carry-in path 61. The guide member 615 guides a sheet S to the carry-in roller pair 612. The guide member 615 also has a function of leading air, which has been fed out from a duct 112 and has not entered an air inlet 611*a*, to a lower surface of the sheet S.

As shown in FIGS. 14 and 15, the presser member 616 is attached to the rotating shaft 613*a* so as to be idly rotatable. The rotating shaft 613*a* is placed downstream of the sheet carry-in path 61 in the sheet conveyance direction. In other words, the presser member 616 is placed downstream of the sheet carry-in path 61 in the sheet conveyance direction.

The presser member 616, with which the sheet S conveyed by the carry-in roller pair 612 has come into contact, is pivoted to a position indicated by solid line in FIG. 14. Meanwhile, when the rear end of the sheet S has passed through the carry-in roller pair 612, the presser member 616 is pivoted to its previous position by its self weight. Then, the presser member 616 presses an upstream-side end portion of the sheet S against the sheet tray 63. The presser member 616 is made from resin.

As shown in FIGS. 4 and 14, the blower device 110 is provided upstream of the carry-in roller pair 612 in the sheet conveyance direction. The blower device 110 blows off air from upstream side toward downstream side of the sheet tray 63 in the sheet conveyance direction. More specifically, the blower device 110 blows off air to between an upper surface of the uppermost sheet S out of sheets S stacked on the sheet tray 63 and a lower surface of a sheet S fed out through the sheet carry-in path 61 to the sheet tray 63.

The blower device 110 includes a blower fan 111 and a duct 112. The blower fan 111 generates an air flow. The duct 112, which is connected to the blower fan 111, feeds out air derived from the blower fan 111. The duct 112 feeds out air in parallel to the sheet tray 63.

As shown in FIG. 14, the sheet carry-in path 61 is made up by including an air inlet 611*a* and a curved guide surface 611*b*. The curved guide surface 611*b* is a part of an inner surface of the sheet carry-in path 61. The curved guide surface 611*b* is provided so as to be curved from right side (image forming apparatus 10 side) to left side (opposite side to image forming apparatus 10 side).

The air inlet 611*a* is provided over a portion of the curved guide surface 611*b* opposed to the duct 112. The air inlet 611*a* lets in air fed out from the duct 112.

The air inlet 611*a* is provided in plurality with a specified interval therebetween in the sheet widthwise direction. That is, partitions (not shown) extending along the sheet conveyance direction are provided between those air inlets 611*a* so as to prevent the sheets S from getting out of the air inlet 611*a*.

The air fed out from the blower device 110 impinges on a lower surface of a sheet S passing through inside the sheet carry-in path 61. The air having impinged on the lower surface of the sheet S subsequently flows along the lower surface of the sheet S, passing through between the lower surface of the sheet S and the rotating shaft 614*a*. Then, the air having passed through between the lower surface of the sheet S and the rotating shaft 614*a* flows to between an upper surface of the uppermost sheet S stacked on the sheet tray 63 and the lower surface of the sheet S fed out from the sheet carry-in path 61 to the sheet tray 63.

On this account, it is implementable to form an air layer between the lower surface of the sheet S (hereinafter, referred to also as subsequent sheet S) fed out from the sheet carry-in path 61 to the sheet tray 63 and the upper surface of the uppermost sheet S (hereinafter, referred to also as uppermost sheet S on the sheet tray 63) out of the sheets S already stacked on the sheet tray 63.

By the air layer being formed, the uppermost sheet S on the sheet tray 63 floats up in the sheet planar direction so as to become farther from the sheet tray 63. The swinging guide 55 is movable from the standby position P1 to the retractive position P2 while the sheet S is floating.

Figure 16:
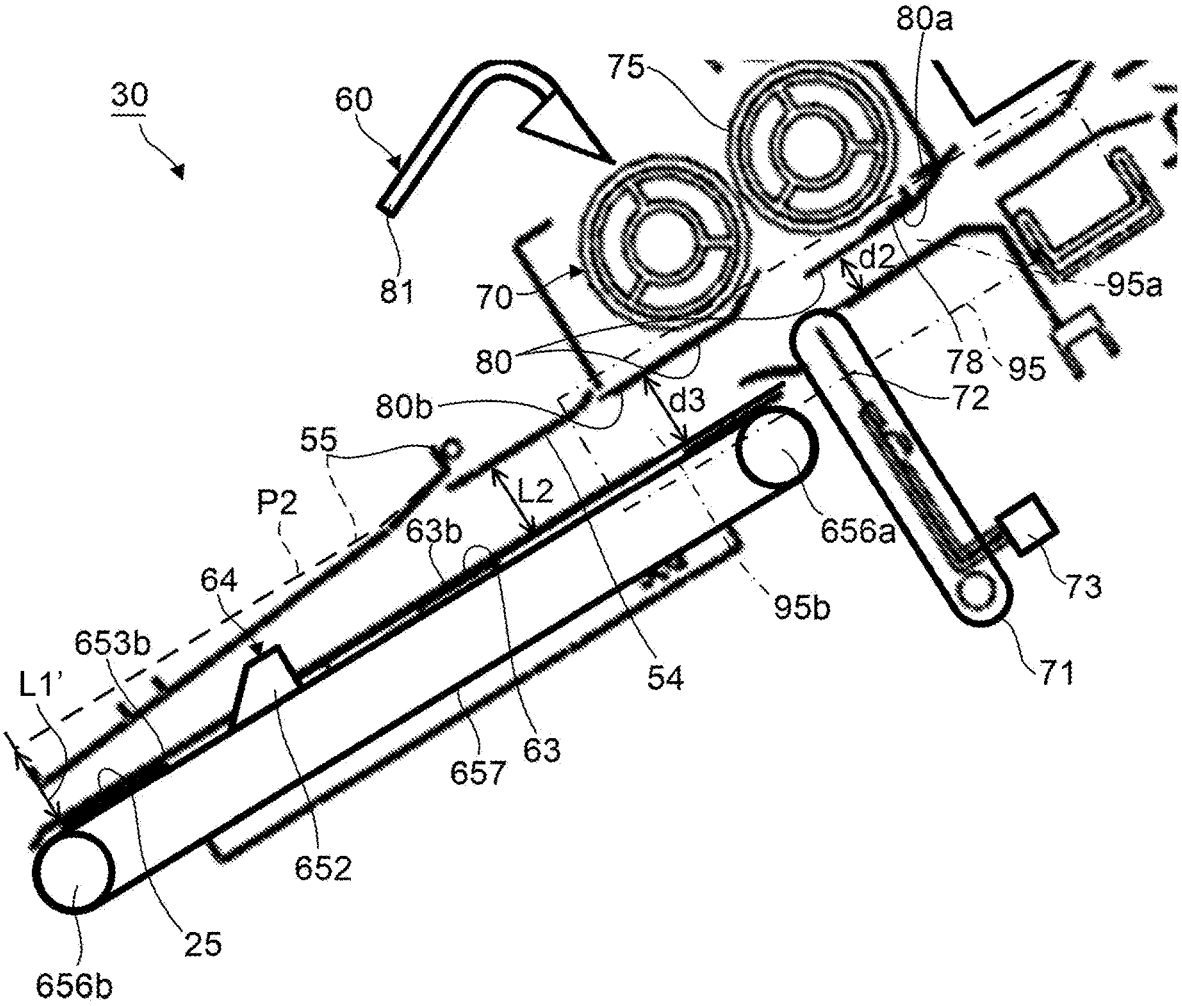
FIG. 16 is an enlarged view showing a vicinity of the downstream-side stacking part under enlargement.

FIG. 16 is an enlarged view showing a vicinity of the downstream-side stacking part 63*b* under enlargement. As shown in FIGS. 4, 14 and 16, spaces through which the air fed out from the blower device 110 passes (a space between the sheet tray 63 and the second stapling device 68, and a space between the sheet tray 63 and the sheet folding device 60) are formed so as to increasingly expand from upstream side toward downstream side in the sheet conveyance direction. More details of this are as follows.

The second clearance is larger than the first clearance in the sheet planar direction. More specifically, oppositional distances d2, d3 between the downstream-side opposing surface 80 and the sheet tray 63 are larger than an oppositional distance d1 between the upstream-side opposing surface 69 and the sheet tray 63 (more specifically, a portion of the sheet tray 63 overlapping with the lower stapling part 68*b* in the sheet conveyance direction).

Also, the oppositional distances d2, d3 between the downstream-side opposing surface 80 and the sheet tray 63 increase more and more toward the downstream side further and further in the sheet conveyance direction. In more detail, the oppositional distance d3 between the second guide surface 80*b* and the sheet tray 63 is equal to or larger than the oppositional distance d2 between the first guide surface 80*a* and the sheet tray 63.

Also, the length L2 between the downstream-side flat portion 54 and the downstream-side stacking surface 25 is equal to or larger than the oppositional distance d3.

Further, while the swinging guide 55 is in the retractive position P2, the length L1' between a portion of the swinging guide 55 closest to the sheet tray 63 (fore end of the up/down portion 59 in this case) and the sheet tray 63 (more specifically, downstream-side stacking surface 25) is larger than the oppositional distance d1. Preferably, the length L1' is larger than the oppositional distances d2, d3.

As described above, in the sheet postprocessing device 30 according to this embodiment, spaces through which air fed out from the blower device 110 passes are so formed as to expand more and more from upstream side toward downstream side further and further in the sheet conveyance direction. Specifically, the second clearance is larger than the first clearance in the sheet planar direction. More specifically, the oppositional distances d2, d3 between the downstream-side opposing surface 80 and the sheet tray 63 are larger than the oppositional distance d1 between the upstream-side opposing surface 69 and the sheet tray 63 (more specifically, upstream-side stacking surface 24). Therefore, the intermediate conveyance part 95 is so structured that the clearance in the sheet planar direction increases more and more from the blower device 110 toward the downstream side further and further in the sheet conveyance direction. Then, air blown from the blower device 110 becomes less likely to undergo resistance in the intermediate conveyance part 95, i.e., comes to flow more easily. Accordingly, air more easily flows to between the upper surface of the uppermost sheet S stacked on the sheet tray 63 and the lower surface of the sheet S fed out from the sheet carry-in path 61 to the sheet tray 63. As a result, it becomes possible to prevent the subsequent sheet S from coming into close contact with the uppermost sheet S on the sheet tray 63, so that occurrence of paper jams can be suppressed.

Also, by the stapling guide 68*c*, it becomes possible to restrict movement of sheets S in the sheet planar direction during the course of the second stapling process for the sheets S. Then, as described above, the oppositional distances d2, d3, which are distances of portions on the downstream side of the oppositional distance d1, are larger than the oppositional distance d1 between the sheet tray 63 and the upstream-side opposing surface 69 formed by the stapling guide 68*c*. Therefore, air comes to more easily flow to between the upper surface of the uppermost sheet S stacked on the sheet tray 63 and the lower surface of the sheet S fed out from the sheet carry-in path 61 to the sheet tray 63 while it is made possible to preferably execute the stapling process by the second stapling device 68.

Also, as described above, the oppositional distances d2, d3 between the downstream-side opposing surface 80 and the sheet tray 63 increase more and more toward the downstream side further and further in the sheet conveyance direction. More specifically, the oppositional distance d3 between the second guide surface 80*b* and the sheet tray 63 is equal to or larger than the oppositional distance d2 between the first guide surface 80*a* and the sheet tray 63. Therefore, air blown from the blower device 110 toward the downstream side in the sheet conveyance direction becomes less likely to undergo resistance, i.e., comes to flow more easily. As a result of this, it becomes possible to more preferably prevent the subsequent sheet S from coming into close contact with the uppermost sheet S on the sheet tray 63.

Also, as described above, the swinging guide 55 is enabled to move from the standby position P1 toward the retractive position P2 when the sheet S is floating. When an air layer is formed by the blower device 110 so that the sheet S has floated, movement of the swinging guide 55 from the standby position P1 toward the retractive position P2 causes the length L1 between a portion (fore end of the up/down portion 59 in this case) of the swinging guide 55 closest to the sheet tray 63 and the sheet tray 63 (more specifically, downstream-side stacking surface 25) to become larger. Then, air blown from the blower device 110 toward the downstream side in the sheet conveyance direction becomes less likely to undergo resistance, i.e., comes to flow more easily.

Also, as described above, while the swinging guide 55 is in the retractive position P2, the length L1' is larger than the oppositional distance d1. Therefore, air blown from the blower device 110 toward the downstream side in the sheet conveyance direction becomes less likely to undergo resistance, i.e., comes to flow more easily.

Also, as described above, the sheet postprocessing device 30 according to this embodiment includes the presser member 616. Therefore, since flotation (curl) of the rear end portion of the sheet S on the sheet tray 63 can be suppressed, a possibility that the downstream-side end portion (fore end portion) of the subsequent sheet S may hitch on the rear end portion of the sheet S on the sheet tray 63 can be suppressed. Thus, occurrence of jams can be suppressed to more extent.

Also, as described above, the sheet tray 63 is inclined downward toward the downstream side. As a result, an approach angle of the subsequent sheet S relative to the sheets S on the sheet tray 63 can be made smaller. That is, the subsequent sheet S can be conveyed in a state nearly parallel to the sheets S on the sheet tray 63. Accordingly, since air comes to flow more easily along the upper surface of the uppermost sheet S on the sheet tray 63 as well as the lower surface of the subsequent sheet S, close contact of the subsequent sheet S with the uppermost sheet S on the sheet tray 63 can be suppressed to more extent.

Also, as described above, since the duct 112 feeds out air in generally parallel to the sheet tray 63, air can be blown (fed out) smoothly to between the uppermost sheet S on the sheet tray 63 and the subsequent sheet S.

The embodiment disclosed herein should be construed as not being limitative but being an exemplification at all points. The scope of the disclosure is defined not by the above description of the embodiment but by the appended claims, including all changes and modifications equivalent in sense and range to the claims.

For example, although the above-described embodiment has been given on an example in which the sheet folding device 60 includes the first folding device 70 and the second folding device 90, the disclosure is not limited to this, and the sheet folding device 60 may be without the second folding device 90.

Further, although the embodiment has been described on a case in which the oppositional length L2 between the downstream-side flat portion 54 and the downstream-side stacking part 63*b* is assumed as distinguishable from the oppositional distance d3 between the downstream-side opposing surface 80 and the sheet tray 63 (=downstream-side stacking part 63*b*), it is also allowable that the oppositional length L2 and the oppositional distance d3 may be regarded as synonymous with each other. In this case, the downstream-side opposing surface 80 is defined as extending up to a downstream end of the downstream-side flat portion 54 on one side closer to the sheet tray 63 in the sheet conveyance direction.

Also, although the above embodiment has been described on a case in which the presser member 616 for pressing the upstream-side end portion (rear end portion) of the sheet S having passed through the carry-in roller pair 612 is provided, the disclosure is not limited to this, and the presser member 616 does not necessarily need to be provided. In this case, it is also allowable that, for example, each time the sheet S is stacked on the sheet tray 63, the lower shifting member 652 is shifted to the upstream side and, before conveyance and coming of the subsequent sheet S, returned to the original position of the lower shifting member 652.

Shifting the lower shifting member 652 to the upstream side as shown above causes the upstream-side end portion (rear end portion) of the sheet S on the sheet tray 63 to be pressed by the driven roller 614 of the carry-in roller pair 612 or the guide member 615. As a result of this, flotation (curl) of the rear end portion of the sheet S on the sheet tray 63 can be suppressed. Thus, a possibility that the subsequent sheet S may hitch on the rear end portion of the sheet S on the sheet tray 63 can be suppressed.

What is claimed is:

1. A sheet postprocessing device comprising:

a sheet conveyance path through which a sheet is conveyed in a specified conveyance direction;

a sheet tray which includes an upstream-side stacking part placed on an upstream side and a downstream-side stacking part placed on a downstream side, each in the conveyance direction, and on which the sheet having passed through the sheet conveyance path is stacked to a specified number;

a carry-in guide which is placed on an upstream side of the sheet tray and at a downstream end of the sheet conveyance path in the conveyance direction, and which carries the sheet onto the sheet tray through the sheet conveyance path;

a processing part which is placed within a range from the upstream-side stacking part to the downstream-side stacking part in the conveyance direction, and which performs specified postprocessing on the sheets stacked on the sheet tray;

a discharge member which is placed on a downstream side of the processing part in the conveyance direction, and which discharges the sheets, which have been subjected to the postprocessing, to the downstream side of the conveyance direction;

a blower device which blows off air from upstream side to downstream side of the conveyance direction and toward between an upper surface of an uppermost sheet out of the sheets stacked on the sheet tray and a lower surface of the sheet carried from the carry-in guide onto the sheet tray; and an intermediate conveyance part which is provided at a position within a range from the upstream-side stacking part to the downstream-side stacking part in the conveyance direction, and through which the sheet passes below the processing part, wherein the intermediate conveyance part includes:

an upstream part including a first clearance through which the sheet passes; and a downstream part placed on a downstream side of the upstream part and including a second clearance through which the sheet passes, a size of the second clearance in a planar direction perpendicular to a surface of the sheet is wider than the first clearance in the planar direction, and the intermediate conveyance part further includes:

an upstream-side guide plate which is placed at a position overlapping with the processing part in the conveyance direction and on an upstream side of the processing part, and which is opposed to the sheet tray in the planar direction; and a downstream-side guide plate which is placed on a downstream side of the processing part in the conveyance direction and downward of the processing part, and which is opposed to the downstream-side stacking part in the planar direction, the first clearance is formed between the upstream-side guide plate and the sheet tray, and the second clearance is formed between the downstream-side stacking part and the downstream-side guide plate.

2. The sheet postprocessing device according to claim 1, wherein an oppositional distance between the downstream-side guide plate and the sheet tray increases more and more toward a downstream side further and further in the conveyance direction.

3. The sheet postprocessing device according to claim 1, further comprising a swinging guide which is placed at a position overlapping with the downstream-side stacking part in the conveyance direction and being upward of the downstream-side stacking part, and which is supported so as to be swingable about a support portion formed at a place upstream of a central portion in the conveyance direction, wherein a third clearance is formed between the swinging guide and the downstream-side stacking part, the swinging guide, while being in a standby position, receives an end portion of the sheet and, when height of sheets stacked on the sheet tray has exceeded a specified value, the swinging guide goes up from the standby position and moreover presses an upper surface of the uppermost sheet out of the sheets stacked on the sheet tray to thereby restrict flotations of the sheets, and while the swinging guide is in the standby position, the third clearance is wider than the first clearance.

4. The sheet postprocessing device according to claim 3, further comprising a width alignment member which is supported by the downstream-side stacking part so as to be reciprocatively movable in a widthwise direction perpendicular to the conveyance direction and to the planar direction, and which is brought into contact with side edges of the sheets stacked on the sheet tray to fulfill width alignment of the sheets, wherein the swinging guide is provided at an upper end portion of the width alignment member.

5. The sheet postprocessing device according to claim 1, further comprising a carry-in member which is placed at a downstream end of the carry-in guide in the conveyance direction and which conveys the sheet to the sheet tray, wherein the blower device is placed upstream of the carry-in member in the conveyance direction.

6. The sheet postprocessing device according to claim 5, further comprising a presser member which is placed downstream of the carry-in guide in the conveyance direction, and which presses an upstream-side end portion of the sheet having passed through the carry-in member.

7. The sheet postprocessing device according to claim 1, wherein the sheet tray is inclined downward toward a downstream side of the conveyance direction.

8. The sheet postprocessing device according to claim 1, wherein the blower device includes:

a blower fan for generating an air flow; and a duct for blowing off air derived from the blower fan in parallel to the sheet tray.

9. The sheet postprocessing device according to claim 1, wherein the processing part includes:

a stapling device for performing a stapling process on a plurality of the sheets stacked on the sheet tray; and a folding device for nipping the sheets stacked on the sheet tray with a folding roller pair to perform a specified folding process on the sheets.

10. An image forming system comprising:

the sheet postprocessing device according to claim 1; and an image forming apparatus which is coupled to the sheet postprocessing device, and which forms an image on the sheet and moreover conveys the sheet, which has been subjected to image formation, to the sheet postprocessing device.

* * * * *